US005111749A

United States Patent [19]

Theurer et al.

[11] Patent Number: 5,111,749

[45] Date of Patent: May 12, 1992

[54] APPARATUS FOR PLACING A CARRIAGE ON A TRACK

[75] Inventors: Josef Theurer, Vienna; Wilhelm Praschl, Linz, both of Austria

[73] Assignee: Franz Plasser Bahnbaumaschinen-Industriegesellschaft m.b.H., Vienna, Austria

[21] Appl. No.: 734,245

[22] Filed: Jul. 22, 1991

[30] Foreign Application Priority Data

Sep. 27, 1990 [AT] Austria ..... 1957/90

[51] Int. Cl.[5] ..... G01B 5/20

[52] U.S. Cl. ..... 104/2; 104/263; 73/146; 33/523.1

[58] Field of Search ..... 104/263, 261, 262, 273, 104/2, 7.1, 7.2, 7.3, 12; 73/146; 33/523.1, 523.2

[56] References Cited

U.S. PATENT DOCUMENTS 3,808,693 5/1974 Plasser et al. ..... 105/178
4,391,134 7/1983 Theurer et al. ..... 73/146
4,654,973 4/1987 Worthy ..... 33/523.1
4,691,565 9/1987 Theurer ..... 73/146
5,052,306 10/1991 Theurer et al. ..... 104/7.2

FOREIGN PATENT DOCUMENTS 2927729 2/1980 Fed. Rep. of Germany .

*Primary Examiner*—Matthew C. Graham
*Assistant Examiner*—Mark T. Le
*Attorney, Agent, or Firm*—Collard, Roe & Galgano

[57] ABSTRACT

An apparatus for placing a carriage linked to a frame of a track working machine on a track comprises a rail sensing element mounted on the carriage for sensing a respective track rail, the rail sensing element being positioned in the radial plane of the flanged wheel when the carriage is placed on the track and emitting a control signal in this position. A hydraulic drive for displacing the carriage transversely with respect to the track links the carriage to the track working machine frame. In response to the control signal, the operation of the hydraulic drive and the transverse displacement of the carriage is interrupted.

14 Claims, 1 Drawing Sheet

APPARATUS FOR PLACING A CARRIAGE ON A TRACK

BACKGROUND OF THE INVENTION

1. Field of the Invention

The present invention relates to an apparatus for placing a carriage on a track comprising two rails, each rail having a rail head, the carriage having a flanged wheel associated with each rail and being linked to a frame of a track working machine mounted for mobility on the track, and drive means linking the carriage to the track working machine frame for displacing the carriage between an inoperative and an operating position, the apparatus comprising a rail sensing element mounted on the carriage for sensing a respective one of the rails.

2. Description of the Prior Art

German patent application No. 2,927,729, published Feb. 21, 1980, discloses an apparatus for placing a carriage on, i.e. guiding it onto, a track, the carriage being linked to a frame of a track working machine by a vertical displacement drive. The carriage is automatically centered by a guide with respect to the center of the track in its raised, inoperative position. The apparatus is linked to the track working machine frame independently of the carriage and is comprised essentially of a pair of levers acting as rail sensing elements. A carrier frame for the pair of levers is linked to the machine frame and the levers are so mounted on the carrier frame that they are pivotal in a vertical plane extending transversely to the track. The pivoting axes of the levers are horizontally spaced a distance corresponding substantially to the track gage. The rail sensing levers are coupled to each other by a synchronization rod so that pivoting of one lever by a pivoting drive causes a mirrorimage movement of the other lever. The levers have free ends acting as rail sensing abutments for engagement with the gage sides of the rail heads. In the rest position of the apparatus, the rail sensing levers are pivoted up towards the center of the track. In the operative position, the pivoting drive is actuated and the levers are synchronously spread apart into engagement with the gage sides of the rail heads. If the apparatus is not accurately centered with respect to the track center, for example when the track working machine travels in a track curve, one lever will necessarily engage the rail head of the associated rail before the other lever does. As the levers are spread further, the carrier frame of the pair of levers is displaced towards the track center until the other lever, too, engages the rail head of the rail associated therewith, and the apparatus is thus accurately centered on the track. In this centered position, the carrier frame of the placing apparatus serves to guide the carriage into a position centered with respect to the track center as it is lowered onto the track. For this purpose, finger-shaped aligning supports are affixed to the carriage, which are deflected by guide ramps affixed to the carrier frame of the placing apparatus until the flanged wheels of the carriage engage the associated rails, i.e. the carriage is guided onto the track and is centered with respect thereto. This apparatus is structurally relatively complicated and may function improperly in superelevated track curves.

U.S. Pat. Nos. 3,808,693, dated May 7, 1974, No. 4,391,134, dated July 5, 1983, and No. 4,691,565, dated Sept. 8, 1987, disclose track measuring and surveying machines with various hydraulically operated and controlled transverse displacement drives for rail sensing elements, including devices for emitting warning signals.

SUMMARY OF THE INVENTION

It is the primary object of this invention to provide an apparatus of the first-indicated type for placing a carriage on a track, which enables the carriage to be centered on the track accurately and without problems.

The above and other objects are accomplished according to the invention with such an apparatus comprising a rail sensing element mounted on the carriage for sensing a respective one of the rails, the rail sensing element being positioned in the radial plane of at least one of the flanged wheels when the carriage is centered on the track and emitting a control signal in the centered position, a hydraulic drive for displacing the carriage transversely with respect to the track, the hydraulic drive being part of the drive means linking the carriage to the track working machine frame, and a means responsive to the control signal and connected to the hydraulic drive for interrupting the transverse displacement upon receiving the control signal. The means responsive to the control signal may comprise a control mechanism controlling the flow of hydraulic fluid to the hydraulic drive and/or a device for emitting a warning signal.

Such a structurally simple apparatus has the considerable advantage that the connection of the carriage with the rail sensing element enables the placing or guiding of the carriage onto the track to be effected very simply by operation of the transverse displacement drive. The carriage is transversely displaced until the rail sensing element indicates the correct position of the associated flanged wheel in vertical alignment with the associated rail, whereupon an operator receiving the warning signal interrupts the transverse displacement or it is interrupted automatically by the control mechanism controlling the flow of hydraulic fluid to the transverse displacement drive. The carriage is then lowered onto the track in the centered position. Since the operation of most track working machines requires a transverse displacement drive for the carriage, such machines need to be retrofitted only with a suitably arranged rail sensing element.

According to a preferred embodiment, the rail sensing element is arranged in a horizontal slide ledge extending transversely with respect to the track, the slide ledge defining a contact surface engageable with the rail head of the one rail, and the apparatus further comprises a drive for vertically adjusting the slide ledge with respect to the flanged wheel associated with the one rail. This arrangement has the advantage that the flanged wheel axle will be automatically aligned parallel to the track plane upon lowering the carriage during the initial stage of the placing procedure in superelevated track curve sections, too, upon engagement of the slide ledge with the track rails. The second stage of the placing procedure requires only an actuation of the transverse displacement drive and the concomitant transverse displacement of the slide ledge with respect to the track rails whereon it slidingly rests, the rail sensing element emitting a control signal upon sensing the associated rail and thus the track position in relation to which the carriage is to be centered. The initial stage advantageously permits the flanged wheels to be kept at a constant level above the rails before they are finally lowered into engagement therewith after the carriage has been centered during the second operating stage. This assures a very dependable, accurate and trouble-free placing which can be effected quite rapidly.

According to one feature of the invention, the rail sensing element is a rocker arm defining a portion of the contact surface of the slide ledge, the rocker arm having a length corresponding substantially to the width of the rail head, a pivot extends parallel to the rail and pivotally supports one end of the rocker arm, and a limit switch is mounted adjacent an end of the rocker arm opposite to the one end and a surface of the rocker arm opposite the contact surface. Such a sensing element will dependably operate in cooperation with the rail head so that the associated flanged wheel will be accurately centered above the rail head and the carriage will be guided onto the rail in a trouble-free manner.

A respective slide ledge may be associated with each rail, a respective rail sensing element being arranged in each slide ledge substantially centered along a length thereof extending transversely with respect to the track. In this embodiment, each slide ledge will be in engagement with the associated rail during the initial stage when the slide ledge is lowered but the carriage is not yet centered, even during operation in sharp curves. Preferably, each slide ledge has two sections adjoining the rail sensing element at respective sides of the rail, one of the slide ledge sections being vertically staggered from the other slide ledge section to form an abutment for engagement with the rail head. This arrangement advantageously limits the transverse displacement of the slide ledge, the abutting engagement of the slide ledge with the rail head and the blocking of the transverse displacement drive in response to the control signal emitted by the rail sensing element fixing the carriage in the desired centered position.

The contact surface of the slide ledge is preferably constituted by an electrically insulating layer to prevent a short circuit between the two rails if the emitted control signal is transmitted by an electrical control circuit.

According to another preferred embodiment, the apparatus further comprises a carrier frame for the slide ledge and a parallelogram linkage connecting the slide ledge to the carrier frame, the drive for vertically adjusting the slide ledge being connected to the parallelogram linkage for pivoting the slide ledge between a lower sensing position and a higher inoperative position. This arrangement advantageously enables the slide ledge to be rapidly lowered into its sensing position in which the placing procedure is then initiated. After the placing procedure has been completed, the slide ledge may then be similarly simply and rapidly raised into its inoperative rest position, in which it does not interfere with the operation of the carriage. A stop may be arranged on the carrier frame for limiting the pivoting movement of the slide ledge when it has reached the lower sensing position. In this way, the slide ledge will be fixed exactly in the sensing position, in which the sensing element in the slide ledge is positioned exactly below the associated flanged wheel, by blocking the pivoting drive.

According to another preferred embodiment, a respective rail sensing element associated with a respective rail is arranged in a horizontal slide ledge extending transversely with respect to the track, the slide ledge defining a contact surface engageable with the rail heads of the rails, and the flanged wheels are vertically adjustably mounted on the carriage, the apparatus further comprising a respective vertical adjustment drive for vertically adjusting the flanged wheels between an inoperative position above the contact surface of the slide ledge and an operative position therebelow. This has the advantage of enabling the slide ledge to be fixedly, rather than pivotally, mounted on the carriage, which is a simpler structure in which the flanged wheels are positioned above the contact surface of the slide ledge during the rail sensing stage. A particularly simple structure still retaining at least most of the advantages hereinabove recited is provided if the slide ledge is comprised of a beam extending across the track over the rails, the rail sensing elements being spaced a distance corresponding to the track gauge, and the beam having a respective end section adjoining each rail sensing element, each beam end section having a minimum length of about 10 inches. The beam may have a respective stepped stop adjacent each rail sensing element, each stop being arranged for engaging a field side of the rail head of the associated rail. This arrangement will enhance the operational dependability of the placing apparatus, assuring a trouble-free and rapid operation.

BRIEF DESCRIPTION OF THE DRAWINGS

The above and other objects, advantages and features of the present invention will become more apparent from the following detailed description of certain now preferred embodiments thereof, taken in conjunction with the accompanying drawing wherein.

DETAILED DESCRIPTION OF PREFERRED EMBODIMENTS

Figure 1:
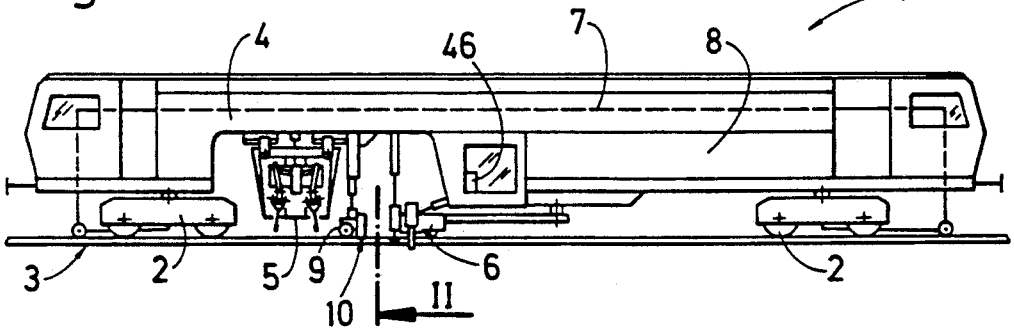
FIG. 1 is a schematic side view of a mobile track working machine illustrated as a track leveling, lining and tamping machine incorporating the apparatus of this invention.

Referring now to the drawing and first to FIG. 1, there is shown track working machine 1 comprising bridge-like machine frame 4 supported by swivel trucks 2, 2 on track 3. The frame of the illustrated track working machine carries two vertically and transversely adjustable tamping heads 5, and track lining and leveling unit 6 is linked to machine frame 4 by lining and lifting drives. Lining and leveling reference system 7 is also mounted on the machine frame for controlling the operation of the lining and lifting drives. The drives of the machine are hydraulically operated, and central power plant 8 on machine frame 4 supplies power to all operating drives of the machine, all operations being controlled from central control panel 46 in an operator's cab arranged on the machine frame within sight of the working tools of the machine. Measuring carriage 9 is linked to machine frame 4 between widely spaced swivel trucks 2 by vertical and transverse displacement drives, and the measuring carriage has flanged wheels whose engagement with a respective one of the track rails monitors the position of track 3. All of this structure and its operation is conventional.

According to the invention, carriage 9 is equipped with apparatus 10 for placing the carriage on track 3, i.e. guiding the carriage onto the track and centering it thereon. One embodiment of this apparatus is illustrated in FIGS. 2 and 3.

Figure 2:
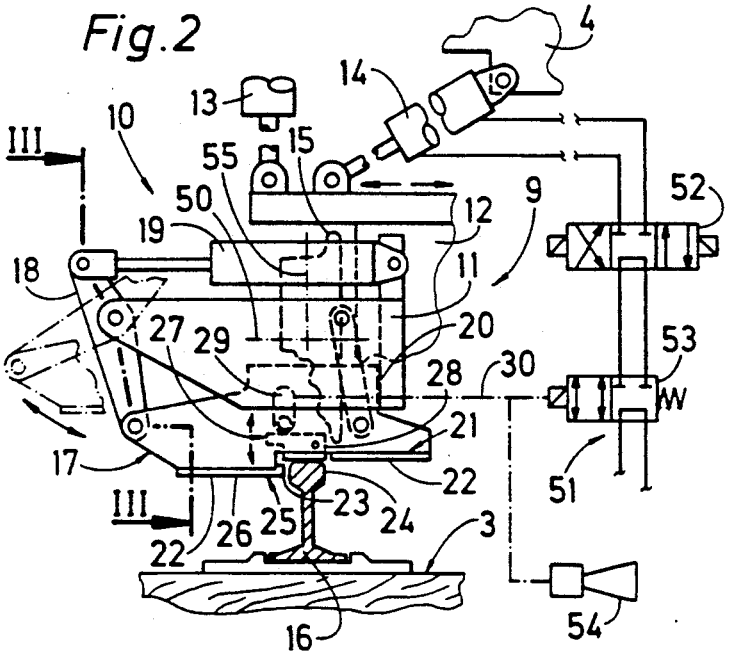
FIG. 2 is a fragmentary and enlarged end view taken in the direction of arrow II of FIG. 1, illustrating one embodiment of the apparatus for placing a carriage linked to the machine on the track.
Figure 3:
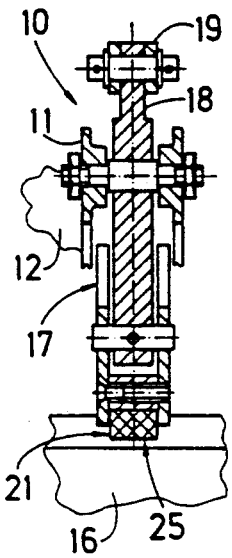
FIG. 3 is a transverse section along line III—III of FIG. 2.

FIGS. 2 and 3 show one half of apparatus 10 for placing measuring carriage 9 on track 3 comprising two rails 16, each rail having a rail head 24, i.e. the operating components associated with one rail, the components associated with the other rail being identical therewith and in mirror-image relation thereto. The carriage has flanged wheel 15 associated with each rail 16, the flanged wheel defining radial plane 55. The carriage is linked to frame 4 of track working machine 1 mounted for mobility on track 3 and drive means illustrated as hydraulic drive 13 links frame 12 of carriage 9 to track working machine frame 4 for displacing the carriage between an inoperative position above track 3 and an operating position in engagement therewith.

Apparatus 10 comprises rail sensing element 27 mounted on carriage 9 for sensing a respective rail 16, the rail sensing element being positioned in radial plane 55 of flanged wheel 15 when the carriage is placed on track 3 and emitting a control signal in this position. Hydraulic drive 14 links frame 12 of measuring carriage 9 to machine frame 4 for displacing the carriage transversely with respect to the track. Means 51 is responsive to the control signal and is connected to hydraulic drive 14 for interrupting the transverse displacement upon receiving the control signal. Illustrated means 51 responsive to the control signal comprises a control mechanism controlling the flow of hydraulic fluid to the hydraulic drive as well as device 54 for emitting a warning signal.

In the illustrated embodiment, the rail sensing element 27 is arranged in a horizontal slide ledge 21 extending transversely with respect to track 3, the slide ledge defining contact surface 25 engageable with rail head 24 of rail 16, and drive 19 enables the slide ledge to be vertically adjusted with respect to flanged wheel 15 associated with rail 16. The illustrated rail sensing element is a rocker arm 28 defining a portion of contact surface 25 of slide ledge 21, the rocker arm having a length corresponding substantially to the width of the rail head. A pivot extends parallel to rail 16 and pivotally supports one end of rocker arm 28, and a limit switch 29 is mounted adjacent an end of the rocker arm opposite to the one end and a surface of the rocker arm opposite the contact surface (see FIG. 2). As indicated hereinabove, a respective slide ledge 21 is associated with each rail 16 of track 3, a respective one of rail sensing elements 27 being arranged in each slide ledge substantially centered along a length thereof extending transversely with respect to the track. Each slide ledge has two sections 22 adjoining rail sensing element 27 at respective sides of rail 16, one of the slide ledge sections 22 being vertically staggered from the other slide ledge section to form abutment 23 for engagement with rail head 24. The length of slide ledge sections 22 is determined by the height of the arc on a chord extending between the spaced swivel trucks 2, 2 in a track curve of minimal radius. The contact surface 25 of the slide ledge as well as that of rocker arm 28 is constituted by an electrically insulating layer 26.

Electrical control circuit 30 connects limit switch 29 to hydraulic fluid flow control 51 and the limit switch is operated by rocker arm 28 when the same is upwardly pivoted by contact with rail head 24 to emit a control signal for the hydraulic fluid flow control. Hydraulic fluid flow control 51 comprises a 4/3-path solenoid valve 52 with a zero flow position and two throughflow positions as well as a 4/2-path solenoid valve 53 with a zero flow position and one throughflow position. Furthermore, control circuit 30 also connects optical and/or acoustic warning signal device 54 to the limit switch so that this device emits a warning signal in response to the control signal emitted by limit switch 29.

In the illustrated apparatus, slide ledge 21 is mounted on carrier frame 11 which is affixed to frame 12 of measuring carriage 9, the latter being vertically and transversely displaceable by drives 13, 14 with respect to machine frame 4. The slide ledge forms the lower edge of a transversely extending frame 17 and is substantially parallel to the track plane and axle 50 of flanged wheel 15. Transverse frame 17 is pivotal in a vertical plane extending transversely to track 3 by a parallelogram linkage consisting of two parallel levers 18 connecting pivotal frame 17 to carrier frame 11, drive 19 for vertically adjusting slide ledge 21 being connected to the parallelogram linkage for pivoting the slide ledge between a lower sensing position (illustrated in full lines in FIG. 2) and a higher inoperative position (illustrated partially in phantom lines). Drive 19 is a spring-loaded hydraulic cylinder. Stop 20 is arranged on carrier frame 11 for limiting the pivoting movement of slide ledge 21, i.e. its support frame 17, when it has reached the lower sensing position illustrated in FIG. 2.

Before measuring carriage 9 is put in operation, it is held in its raised, inoperative position above track 3. The operation of apparatus 10 for placing the carriage on the track is initiated by actuating pivoting drive 19 to pivot frame 17 into its lowered rail sensing position until the pivoting movement of the frame is halted by its engagement with stop 20. As illustrated in FIG. 2, in this position rail sensing element 27 in slide ledge 21 is positioned vertically below flanged wheel 15 in its radial plane 55 extending perpendicularly to wheel axle 50. At this point, vertical adjustment drive 13 is actuated to lower carrier frame 12 of measuring carriage 9 until slide ledge 21 rests on rail head 24. Upon subsequent actuation of transverse adjustment drive 14, carrier frame 12 and sliding ledge 21 with rail sensing element 27 perform a transverse displacement and rail sensing movement until abutment 23 of the sliding ledge engages rail head 24, in which position flanged wheel 15 is in the desired position for placing the measuring carriage on the track, i.e. radial plane 55 of flanged wheel 15 substantially coincides with the vertical plane of symmetry of rail 16. Simultaneously, rail head 24 will pivot rail sensing rocker arm 28 upwardly until the free end of the rocker arm actuates limit switch 29 to emit a control signal transmitted by control circuit 30 to control mechanism 5 and warning signal device 54. The subsequent electromagnetic operation of slide valve 53 to assume its zero flow position will interrupt the flow of hydraulic fluid to drive 14 so that the transverse displacement is discontinued and the rail sensing operation is terminated. Simultaneously, an operator at control panel 46 will receive an optical and/or acoustical warning signal from device 14 to indicate the correct, centered position of flanged wheels 15 above their associated rails. Pivoting drive 14 is now actuated to raise frame 17 and its sliding ledge 21 into the inoperative position, whereupon hydraulic drive 13 is actuated to lower carrier frame 12 of measuring carriage 9 into its operative position, in which flanged wheels 15 engage rails 16. A return spring moves slide valve 53 into its flow-through position so that transverse displacement drive 14 may be actuated during the track position monitoring operation for laterally pressing measuring carriage 9 against a selected one of rails 16 during the operation of track working machine 1, as is conventional.

Figure 5:
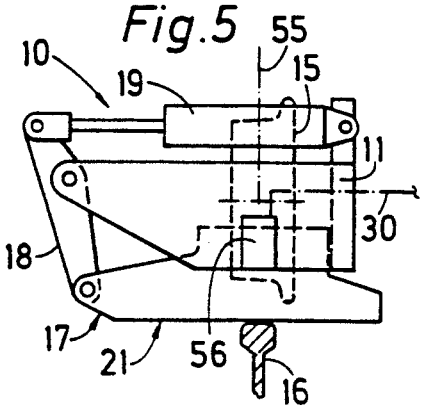
FIG. 5 is a fragmentary and enlarged end view of the embodiment of FIG. 2, showing another embodiment of a rail sensing element for the apparatus.

In FIG. 5, like reference numerals designate like parts operating in a like manner as in the embodiment of FIGS. 2 and 3. In this embodiment, however, the rail sensing element is an inductive proximity switch 56 mounted centrally on frame 11 with respect to radial plane 55 of flanged wheel 15 for sending rail 15 without physical contact therewith. Apparatus 10 otherwise operates in the above-described manner, slide ledge 21 being contacted with the rail head and the whole apparatus being transversely displaced until rail sensing element 56 is aligned vertically with rail 16, at which time the proximity switch will emit a control signal transmitted by control circuit 30 to control mechanism 51 and warning signal device 54.

Figure 4:
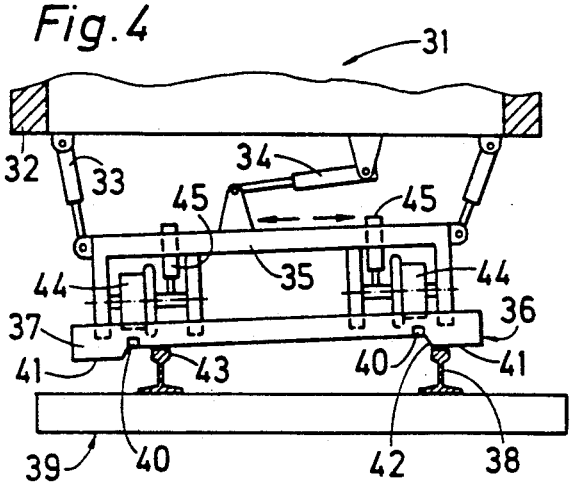
FIG. 4 is an enlarged end view illustrating another embodiment of the apparatus.

FIG.4 illustrates another embodiment of an apparatus for placing carriage 35 on track 39 comprising two rails 38, each rail having a rail head 43. The carriage has flanged wheels 44 associated with the rails, carriage 35 being linked to a frame 32 of a track working machine 31 mounted for mobility on track 39 and vertical and transverse displacement drives 33, 34 link the carriage to track working machine frame 32. Carriage 35 may support any desired operating tools (not illustrated), for example rollers engageable with the track rails for lifting and/or lining the track. The apparatus of this embodiment of the invention has a respective rail sensing element 40 associated with a respective rail 38, and the rail sensing elements are arranged in a horizontal slide ledge 36 extending transversely with respect to track 39. The slide ledge defines a contact surface engageable with rail heads 43 of rails 38, and flanged wheels 44 are vertically adjustably mounted in vertical guides affixed to carriage 35. Respective vertical adjustment drive 45 connects the axle of each flanged wheel to carriage 35 for vertically adjusting the flanged wheels between an inoperative position above the contact surface of slide ledge 36 and an operative position therebelow. In the illustrated apparatus, the slide ledge is comprised of a beam 37 extending across track 39 over rails 38, rail sensing elements 40, 40 being spaced a distance corresponding to the track gauge, and the beam having a respective end section 41 adjoining each rail sensing element 40. Each beam end section 41 has a minimum length of about 10 inches. The two end sections are vertically staggered from a center section of beam 37, whereby the beam has a respective stepped stop 42 adjacent each rail sensing element 40, each stop being arranged for engaging a field side of rail head 24 of associated rail 38. The length of beam end sections 41 corresponds to the required transverse displacement of carriage 35 in track curves, depending on the spacing of the swivel trucks or other undercarriages supporting machine frame 32 for mobility on track 39. In the raised, inoperative position shown in FIG. 4, flanged wheels 44 are positioned above rail sensing elements 40 and the contact surface of sliding ledge 36.

The placing and centering of carriage 35 on track 39 is initiated by actuating drives 33 to lower the carriage into the position illustrated in FIG. 4, wherein slide ledge 36 rests on rail heads 43. Transverse displacement drive 34 is then actuated until the carriage is sufficiently displaced transversely to engage stops 42 with the field sides of the rail heads, in which position rail sensing elements 40 are aligned with rails 38 and emit a control signal for interrupting the actuation of drive 34 in a manner hereinabove described. Flanged wheels 44 are now in vertical alignment with associated rails 38 and, in this centered position, drives 45 are actuated to lower the flanged wheels into engagement with the rail heads. Further downward pressure of drives 45 against rail heads 43, while the pressure in vertical displacement drives 33 is relieved, will cause carriage 35 to be upwardly displaced so that slide ledge 36 affixed to the carriage is disengaged from the rail heads. The carriage may now run on track rails 38 by means of flanged wheels 44 engaging the rail heads.

If desired, an automatic control mechanism responsive to the control signal emitted by the rail sensing element may be omitted and the actuation of transverse displacement drive 14 or 34 may be effected by an operator upon receipt of a warning signal in response to the control signal.

What is claimed is:

1. An apparatus for placing a carriage on a track comprising two rails, each rail having a rail head, the carriage having a flanged wheel associated with each rail, the flanged wheel defining a radial plane, the carriage being linked to a frame of a track working machine mounted for mobility on the track and drive means linking the carriage to the track working machine frame for displacing the carriage between an inoperative and an operating position, the apparatus comprising (a) a rail sensing element mounted on the carriage for sensing a respective one of the rails, the rail sensing element being positioned in the radial plane of at least one of the flanged wheels when the carriage is placed on the track and emitting a control signal in this position, (b) a hydraulic drive for displacing the carriage transversely with respect to the track, the hydraulic drive being part of the drive means linking the carriage to the track working machine frame, and (c) a means responsive to the control signal and connected to the hydraulic drive for interrupting the transverse displacement upon receiving the control signal.

2. The apparatus of claim 1, wherein the means responsive to the control signal comprises a control mechanism controlling the flow of hydraulic fluid to the hydraulic drive.

3. The apparatus of claim 1, wherein the means responsive to the control signal comprises a device for emitting a warning signal.

4. The apparatus of claim , wherein the means responsive to the control signal comprises a control mechanism controlling the flow of hydraulic fluid to the hydraulic drive and a device for emitting a warning signal.

5. The apparatus of claim 1, wherein the rail sensing element is arranged in a horizontal slide ledge extending transversely with respect to the track, the slide ledge defining a contact surface engageable with the rail head of the one rail, and further comprising a drive for vertically adjusting the slide ledge with respect to the flanged wheel associated with the one rail.

6. The apparatus of claim 5, wherein the rail sensing element is a rocker arm defining a portion of the contact surface of the slide ledge, the rocker arm having a length corresponding substantially to the width of the rail head, a pivot extending parallel to the rail and pivotally supporting one end of the rocker arm, and a limit switch mounted adjacent an end of the rocker arm opposite to the one end and a surface of the rocker arm opposite the contact surface.

7. The apparatus of claim 5, wherein a slide ledge is associated with each rail, a rail sensing element being arranged in each slide ledge substantially centered along a length thereof extending transversely with respect to the track.

8. The apparatus of claim 7, wherein each slide ledge has two sections adjoining the rail sensing element at respective sides of the rail, one of the slide ledge sections being vertically staggered from the other slide ledge section to form an abutment for engagement with the rail head.

9. The apparatus of claim 5, wherein the contact surface of the slide ledge is constituted by an electrically insulating layer.

10. The apparatus of claim 5, further comprising a carrier frame for the slide ledge and a parallelogram linkage connecting the slide ledge to the carrier frame, the drive for vertically adjusting the slide ledge being connected to the parallelogram linkage for pivoting the slide ledge between a lower sensing position and a higher inoperative position.

11. The apparatus of claim 10. further comprising a stop arranged on the carrier frame for limiting the pivoting movement of the slide ledge when it has reached the lower sensing position.

12. The apparatus of claim 1, wherein a respective one of the rail sensing elements associated with a respective one of the rails is arranged in a horizontal slide ledge extending transversely with respect to the track, the slide ledge defining a contact surface engageable with the rail heads of the rails, and the flanged wheels are vertically adjustably mounted on the carriage, further comprising a respective vertical adjustment drive for vertically adjusting the flanged wheels between an inoperative position above the contact surface of the slide ledge and an operative position therebelow.

13. The apparatus of claim 10, wherein the slide ledge is comprised of a beam extending across the track over the rails, the rail sensing elements being spaced a distance corresponding to the track gauge, and the beam having a respective end section adjoining each rail sensing element, each beam end section having a minimum length of about 10 inches.

14. The apparatus of claim 13, wherein the beam has a respective stepped stop adjacent each rail sensing element, each stop being arranged for engaging a field side of the rail head of the associated rail.

* * * * *